US005499410A

United States Patent [19]

Assink

[11] Patent Number: 5,499,410

[45] Date of Patent: Mar. 19, 1996

[54] COUPLING DEVICE FOR A MATTRESS

[75] Inventor: Bernardus A. T. F. Assink, Schalkhaar, Netherlands

[73] Assignee: Koninklijke Auping B.V., Deventer, Netherlands

[21] Appl. No.: 270,673

[22] Filed: Jul. 5, 1994

[30] Foreign Application Priority Data

Jul. 5, 1993 [NL] Netherlands ..... 9301174

[51] Int. Cl.[6] ..... A47C 21/00

[52] U.S. Cl. ..... 5/411; 5/284

[58] Field of Search ..... 5/400, 402, 410, 5/411, 284, 421

[56] References Cited

U.S. PATENT DOCUMENTS

| | | | |
|---|---|---|---|
| 2,995,762 | 8/1961 | Albinson | 5/411 |
| 3,049,729 | 8/1962 | Broyles | 5/411 |
| 3,116,494 | 1/1964 | Bennett et al. | 5/411 X |
| 3,818,519 | 6/1974 | Schuder | 5/411 |
| 3,837,020 | 9/1974 | Busch | 5/411 |
| 4,726,083 | 2/1988 | Hoshall | 5/922 X |

FOREIGN PATENT DOCUMENTS 6913442 9/1969 Netherlands .

*Primary Examiner*—Michael F. Trettel
*Attorney, Agent, or Firm*—Leydig, Voit & Mayer

[57] ABSTRACT

A coupling device for coupling a mattress to a mattress base comprises a lower coupling element, which can be attached to the mattress base, and an upper coupling element, which can be attached to the mattress, which lower coupling element and upper coupling element can be mechanically connected to one another. To facilitate the making of said connection, said upper coupling element and lower coupling element can be coupled in various positions which are offset with respect to one another. Furthermore, upper coupling element and lower coupling element can also be coupled electrically.

14 Claims, 3 Drawing Sheets

COUPLING DEVICE FOR A MATTRESS

BACKGROUND OF THE INVENTION

1. Field of the Invention

The invention relates to a coupling device for coupling a mattress to a mattress base, comprising a lower coupling element, which can be attached to the mattress base, and an upper coupling element, which can be attached to the mattress, which lower coupling element and upper coupling element can be mechanically coupled to one another.

2. Description of Related Art

A coupling of this type between mattress and mattress base is disclosed in NL-A-6,913,442. The advantage is that the mattress is held in place with respect to the mattress base. This is particularly important in the case of mattresses which have an adjustable head and/or foot end. With mattresses of this type, a mattress which is lying loose on the base can easily shift, whilst it also follows the movements of the mattress base less

SUMMARY OF THE INVENTION

The aim of the invention is to provide a coupling device, of the type described above, which is more versatile and which can easily be fixed in several positions. This aim is achieved in that the upper coupling element and lower coupling element can be coupled in various positions which are offset with respect to one another.

The coupling elements can be attached to one another in various ways. A user-friendly type of connection is the snap fastening, where both coupling elements carry protrusions, of which at least the protrusions on one of the coupling elements are in spaced relationship to one another to form an undercut cavity into which the protrusions on the other coupling element can be hooked.

The known coupling devices also have the disadvantage that the two coupling elements have to be accurately positioned opposite one another before they can be made to interact. It is therefore desirable, with a view to further improvement in user-friendliness and versatility, to construct the coupling device in such a way that the latter is also capable of producing a coupling when the two coupling elements are less accurately positioned with respect to one another. To this end, one of the coupling elements comprises a multiplicity of undercut cavities which in the transverse direction are located alongside one another and which each have a constant cross-section in the longitudinal direction, and the other coupling element comprises a rib which has a widened top and likewise has a constant cross-section in the longitudinal direction.

On the one hand, the rib can still be accommodated correctly in the cavity concerned in various positions offset in its longitudinal direction. On the other hand, the rib can be accommodated, transversely to its longitudinal direction, in one of the cavities available in that direction. In this way, the mattress can, within certain limits, be offset in two mutually perpendicular directions in the horizontal plane and still be coupled to the mattress base.

In order to increase the mechanical stability of the coupling, further ribs are provided on the coupling element provided with a rib having a widened top, which further ribs are parallel to the latter rib, and each pair of said further ribs defines a groove in which in each case one widened top of the other coupling element can be accommodated.

The versatility of the coupling element according to the invention can be even further increased if the upper coupling element and lower coupling element can also be coupled electrically.

In the latter case, the coupling device according to the invention is suitable not only for mutual positioning of mattress base and mattress but also for producing an electrical connection, for example to supply electricity to a heating device.

With this arrangement, at least one of the protrusions of one coupling element and at least one of the protrusions of the other coupling element carry an electrical contact, which contacts are fitted in locations such that they touch one another when the coupling elements are mechanically coupled.

According to a preferred embodiment, the cavities carry electrical contacts on the sides facing one another and the rib carries electrical contacts on its longitudinal sides which face away from one another.

It is also possible for corrugations to extend transversely between each pair of ribs and for the other coupling element to carry pins, each pair of said pins forming an undercut cavity, which pins can be accommodated by their free ends between, in each case, one pair of ribs and one pair of corrugations extending transversely between said ribs.

In the latter case the coupling element which carries the pins is the lower coupling element and the pins have a mutual spacing which corresponds to the mesh spacing of a mattress base which has wires twisted together in the form of interlocking spirals, and the contacts are insulated at least over a height equal to the thickness of the mattress base.

It is pointed out that the use of the coupling device according to the invention is not restricted to mattress bases which have wires twisted together in the form of interlocking spirals. It can, for example, also be used with slatted bases.

The invention will now be discussed in more detail with the aid of an illustrative embodiment shown in the figures.

BRIEF DESCRIPTION OF THE DRAWINGS

FIG. 3 shows a partially exposed perspective view of the lower coupling element, seen obliquely from above.

DESCRIPTION OF THE PREFERRED EMBODIMENTS

Figure 1:
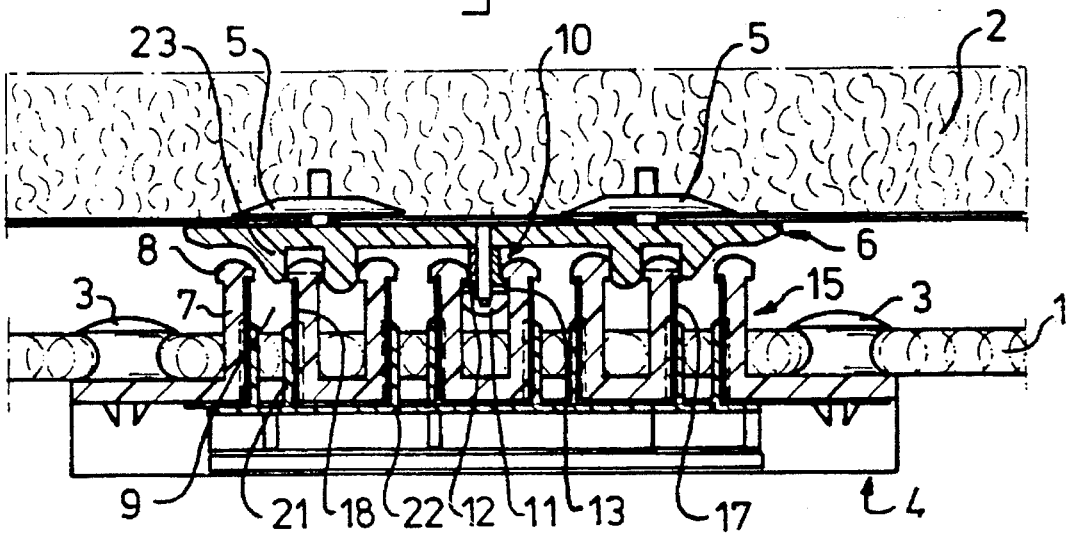
FIG. 1 shows a side view, partially in cross-section, of the coupling device according to the invention.
Figure 2:
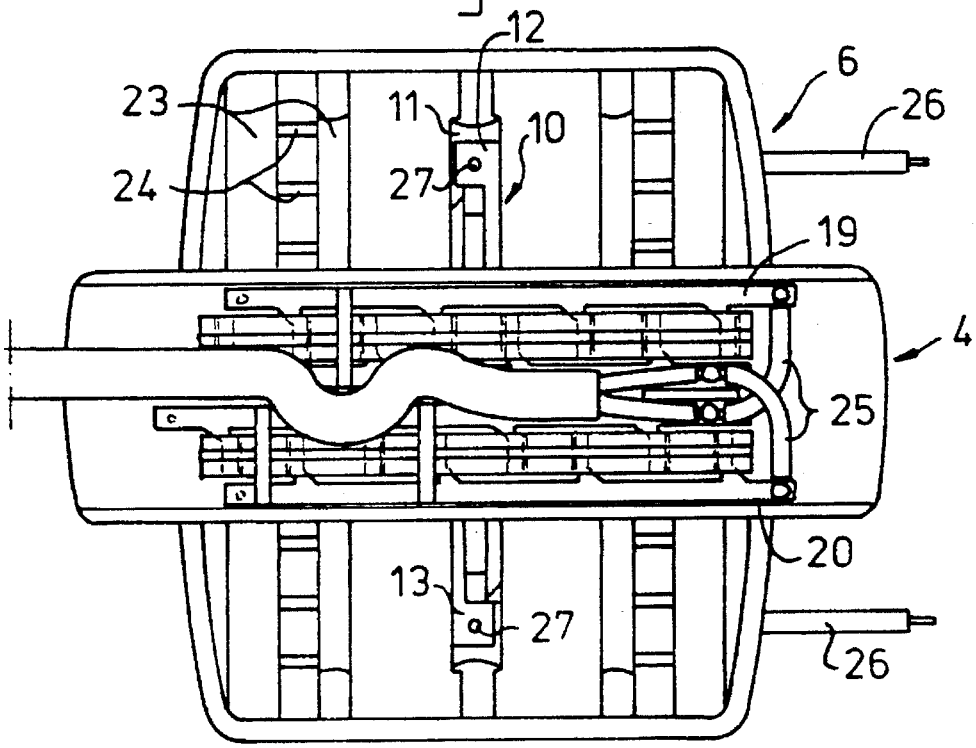
FIG. 2 shows a view of the coupling device according to the invention from below.
Figure 2:
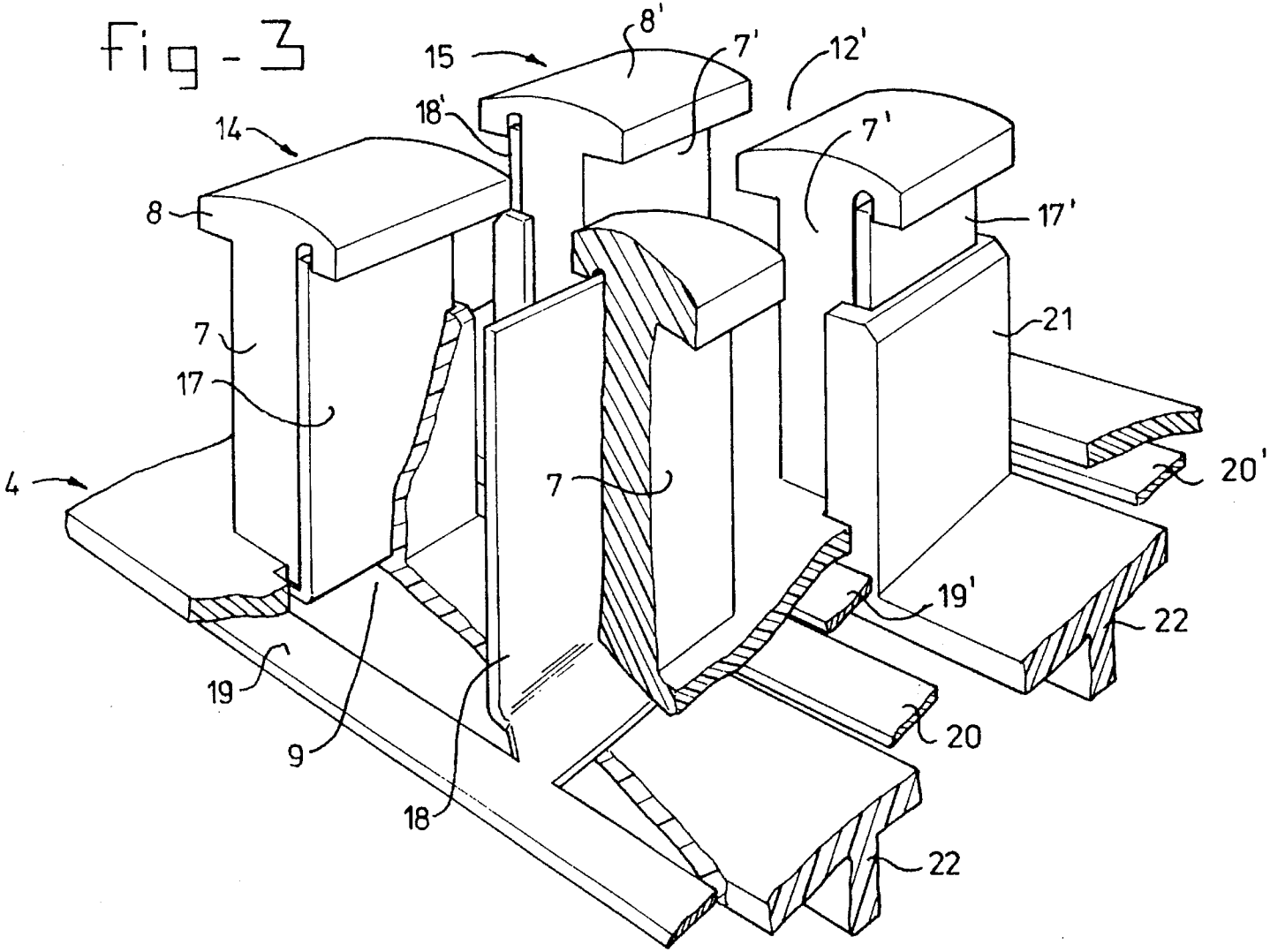
Figure 4:
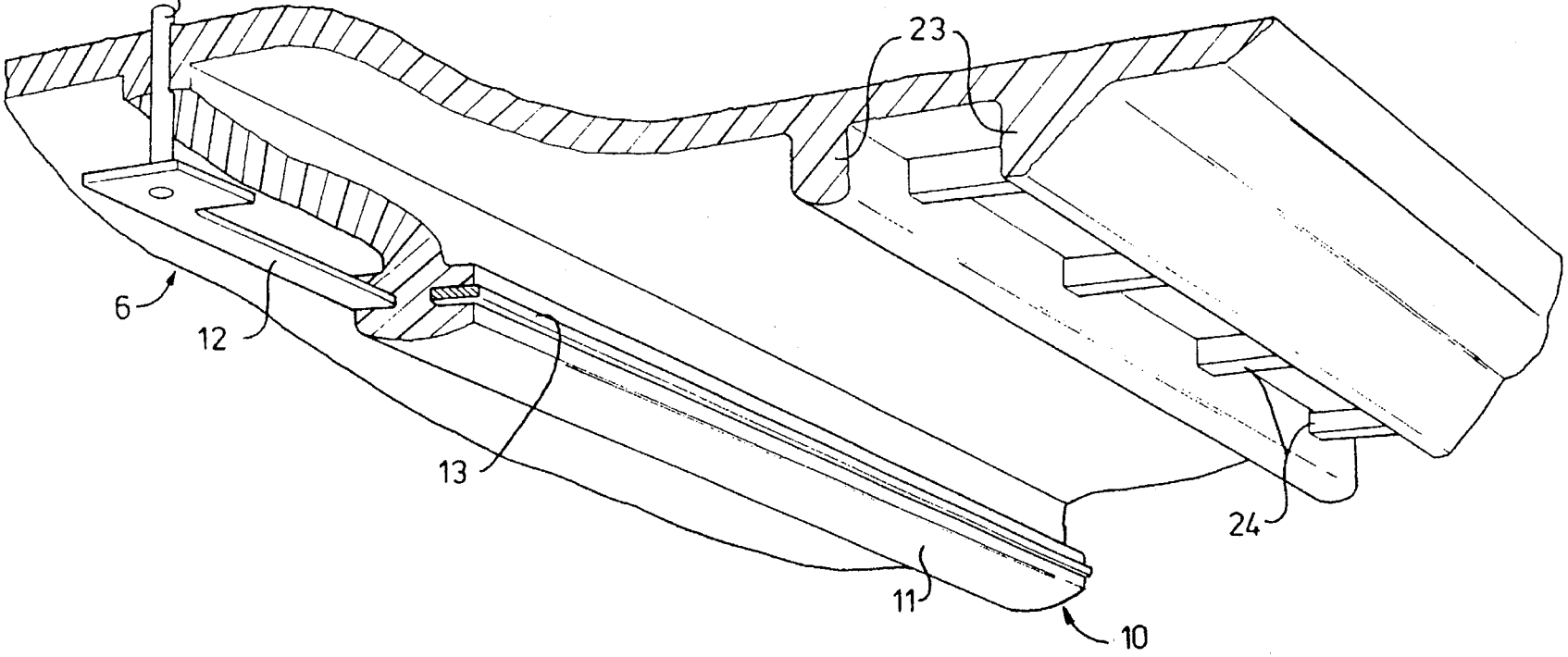
FIG. 4 shows a partially exposed perspective view of the upper coupling element, seen obliquely from below.

FIG. 1 shows a transverse view of a mattress base 1, which in the known manner is constructed of wires twisted together in the form of interlocking spirals. Part of a mattress 2 is also shown in cross-section.

A lower coupling element 4 is attached to the mattress base 1 by means of snap fastenings 3 and an upper coupling element 6 is attached to the mattress 2 by means of snap fastenings 5.

The lower coupling element 4 carries protrosions, such as pins 7, each of which has a widened top 8. As can be seen in FIG. 3, the pins have a constant cross-section in their longitudinal direction. Two pins define one undercut cavity 9 in each case, into which cavity a different protrusion, such as rib 10, having a widened top 11, of the upper coupling element 6 can be snapped.

As shown in FIG. 1, the rib 10 is snapped into the central cavity in the element. It will be clear that the rib 10 can also be snapped into the cavity between any other pair of opposing pins 7.

As can also be seen in FIG. 1, two opposing pins carry electrical contacts 17, 18 in each case. The strips 12, 13 which are fitted on the rib 10 of the upper coupling element 6 are in contact with the electrical contacts 17, 18.

FIG. 3 shows that the lower coupling element 4 has two rows, 14 and 15, of pins, 7 and 7' respectively, the pins in each row being located alongside one another transversely to their longitudinal direction and defining an undercut cavity 9. In row 14, the pins 7 carry a contact, 17 and 18 respectively, on the sides facing one another. In row 15, however, the corresponding pins 7' do not carry a contact on their sides facing one another. The pins 7' and 16' carry a contact 17 on each of the sides facing away from one another, in such a way that they, with the pin located on that side, define a pair of contacts 17' and 18' respectively, which pair of contacts interact with the strips 12 and 13 respectively fitted on the ribs 10.

Rib 10 is always located between the pins 7' of row 15 and pins 7 of row 14. In the embodiment shown in FIG. 1 the electrical contact between the strips 12, 13 of rib 10 and the contacts 17, 18 takes place at the pins 7' of row 15, which, however, can not be seen in FIG. 1.

As is further shown in FIGS. 1, 2, 3 and 4, the contacts 17 of row 14 are each connected to electrically conducting strip 20, whilst the contacts 18 are each connected to an electrically conducting strip 19. In a corresponding manner, the contacts 17' of row 15 are connected to strip 20', whilst the contacts 18' are connected to the conducting strip 19'.

In order to prevent short-circuiting of the contacts 17, 18 and 17', 18' with the mattress base 1, said contacts are insulated over part of their height by means of caps 21, which are integral with strip 22.

The upper coupling element additionally comprises further pairs of ribs 23, between which transverse corrugations 24 extend. The widened top 8 of the pins 7 can be accommodated between, in each case, one such pair of ribs 23 and two corrugations 24. This prevents the upper coupling element 6 from being able to shift in the longitudinal direction of the ribs 23 with respect to the lower coupling element 4 when the mattress 2 is pressed down firmly on the mattress base 1.

The upper coupling element 6 can be attached to the lower coupling element 4 in various locations, that is to say such that the rib 10 comes to rest in one of the cavities 9 defined by the various pairs of pins 7. In the direction perpendicular thereto, the rib 10 can be moved in such a cavity 9, whilst said direction can nevertheless be held well because the widened tops 8 come to rest between the corrugations 24.

The electrical leads 25 are connected to a power source, which is not shown; the electrical leads 26 can, for example, be connected to a heating device accommodated in the mattress. The leads 26 are connected to the strips 12, 13 by means of pins 27.

I claim:

1. Coupling device for coupling a mattress to a mattress base in a variety of positions in the same plane, comprising a lower coupling element attached to the mattress base and an upper coupling element attached to the mattress, each of the lower and upper coupling elements including protrusions, at least some of the protrusions on one of the coupling elements being arranged in spaced relationship to one another to define a plurality of cavities engageable with the protrusions on the other coupling element.

2. Device according to claim 1 wherein one of the coupling elements comprises a plurality of cavities which are located alongside one another in a first direction, each cavity having a constant cross-section in the first direction, and the other coupling element comprises a rib arranged in a second direction substantially perpendicular to the first direction and having a widened top portion and likewise having a constant cross-section in the first direction, such that the rib can be accommodated in various positions in the second direction, in a cavity and the rib can be accommodated in various cavities in the first.

3. Device according to claim 2, wherein further ribs are provided on one of said upper and lower coupling elements provided with a rib having a widened top, which further ribs are parallel to said rib, and a pair of said further rib defines a groove in which in each case one widened top of the other of said upper and lower coupling elements can be accommodated.

4. Device according to claim 3, wherein corrugations extend transversely between each pair of said further ribs and the other of said upper and lower coupling elements carries pins, each pair of said pins forming a cavity, which pins can be accommodated by their free ends between, in each case, one pair of said further ribs and one pair of corrugations, extending transversely between said further ribs, of said one of said upper and lower coupling elements.

5. Device according to claim 4 wherein said upper coupling element and said lower coupling element include electrical contacts and can also be coupled electrically.

6. Device according to claim 5 wherein at least one of the protrusions of one of said upper and lower coupling elements and at least one of the protrusions of the other of said upper and lower coupling elements carry an electrical contact, which contacts are fitted in locations such that they touch one another when the coupling elements are mechanically coupled.

7. Device according to claim 6, wherein the coupling element which carries the pins is the lower coupling element and the pins have a mutual spacing which corresponds to the mesh spacing of a mattress base which has wires twisted together in the form of interlocking spirals, and the contacts are insulated at least over a height equal to the thickness of the mattress base.

8. Device according to claim 2 wherein said upper coupling element and said lower coupling element include electrical contacts and can also be coupled electrically.

9. Device according to claim 8, wherein the cavities carry electrical contacts on sides of protrusions facing one another and the rib carries electrical contacts on its sides which face away from one another.

10. Device according to claim 1 wherein said upper coupling element and said lower coupling element include electrical contacts and can also be coupled electrically.

11. Device according to claim 1 wherein the coupling elements are attached by snap fastenings to the mattress base and to the mattress respectively.

12. Coupling device for coupling a mattress to a mattress base, comprising a lower coupling element attached to the mattress base and an upper coupling element attached to the mattress, the lower coupling element and upper coupling element being mechanically coupleable to one another, one of the coupling elements comprising at least one protrusion having a constant cross-section in its longitudinal direction and the other coupling element comprising at least two cavities located alongside one another, such that the at least one protrusion can be accommodated in various positions, offset in its longitudinal direction, in any of the cavities.

13. Device according to claim 12 wherein said upper coupling element and said lower coupling element include electrical contacts and can also be coupled electrically.

14. Device according to claim 13 wherein at least one of the protrusions of one of said upper and lower coupling elements and at least one of the protrusions of the other of said upper and lower coupling elements carry an electrical contact, which contacts are fitted in locations such that they touch one another when the coupling elements are mechanically coupled.

* * * * *

UNITED STATES PATENT AND TRADEMARK OFFICE

CERTIFICATE OF CORRECTION

PATENT NO. : 5,499,410

DATED : March 19, 1996

INVENTOR(S) : Assink

It is certified that error appears in the above-indentified patent and that said Letters Patent is hereby corrected as shown below: On the title page, Item: 57; delete "abstract in its entirety" and insert the following:

--A coupling device for coupling a mattress to a mattress base in a variety of positions in the same plane, including a lower coupling element attached to the mattress base and an upper coupling element attached to the mattress, each of the lower and upper coupling elements including protrusions, at least some of the protrusions on one of the coupling elements being arranged in spaced relationship to one another to define a plurality of cavities engageable with the protrusions on the other coupling element.--;

UNITED STATES PATENT AND TRADEMARK OFFICE

CERTIFICATE OF CORRECTION

PATENT NO. : 5,499,410

DATED : March 19, 1996

INVENTOR(S) : Assink

It is certified that error appears in the above-indentified patent and that said Letters Patent is hereby corrected as shown below:

Column 4, line 15, after "first" insert --direction--.

Signed and Sealed this

Thirteenth Day of August, 1996

*Attest:*

Bruce Lehman

BRUCE LEHMAN

*Attesting Officer*

*Commissioner of Patents and Trademarks*